US006183879B1

(12) United States Patent
Deeley

(10) Patent No.: US 6,183,879 B1
(45) Date of Patent: Feb. 6, 2001

(54) RIGID THIN SHEET MATERIAL AND METHOD OF MAKING IT

(75) Inventor: Geoffrey Thomas Deeley, Oldbury (GB)

(73) Assignee: Hadley Industries, PLC (GB)

( * ) Notice: Under 35 U.S.C. 154(b), the term of this patent shall be extended for 0 days.

(21) Appl. No.: 09/142,279

(22) PCT Filed: Mar. 20, 1997

(86) PCT No.: PCT/GB97/00790

§ 371 Date: Sep. 3, 1998

§ 102(e) Date: Sep. 3, 1998

(87) PCT Pub. No.: WO97/35674

PCT Pub. Date: Oct. 2, 1997

(30) Foreign Application Priority Data

Mar. 26, 1996 (GB) ..... 9606289

(51) Int. Cl.[7] ..... B21D 13/00; B22F 5/00; B32B 3/28; B32B 3/30

(52) U.S. Cl. ..... 428/604; 428/687; 42/30; 29/592; 29/421.1; 72/199; 72/212; 72/226; 72/234

(58) Field of Search ..... 72/199, 212, 226, 72/234; 29/592, 421.1; 492/30; 428/604, 687

(56) References Cited

FOREIGN PATENT DOCUMENTS

| | | | |
|---|---|---|---|
| 486281 | 2/1970 | (CH) | B21D/13/10 |
| 0 139 066 | 5/1985 | (EP) | B21D/22/08 |
| 0 167 874 | 1/1986 | (EP) | B21C/47/26 |
| 2279596 | 1/1995 | (GB) | B21D/22/04 |
| WO 94/12294 | 6/1994 | (WO) | B21D/13/04 |

*Primary Examiner*—Deborah Jones
*Assistant Examiner*—Lymarie Miranda
(74) *Attorney, Agent, or Firm*—Caesar, Rivise, Bernstein, Cohen & Pokotilow, Ltd.

(57) ABSTRACT

Lightweight flexure-resistant thin metal sheet is produced by passing flexible thin metal sheet between rolls having defined teeth, the teeth having radiused corners so that rows of projections are formed on both faces of the sheet without damage to the surface material or the rolls.

11 Claims, 4 Drawing Sheets

RIGID THIN SHEET MATERIAL AND METHOD OF MAKING IT

CROSS-REFERENCES TO RELATED APPLICATIONS

Not applicable

STATEMENT REGARDING FEDERALLY SPONSORED RESEARCH OR DEVELOPMENT

Not applicable

BACKGROUND OF THE INVENTION

The invention relates to a method of making thin sheet metal material relatively rigid.

In our prior patent application WO 94112294 published on Jun. 9, 1994 (Agent's Ref: P01448PCT) we have disclosed a method of forming projections in a thin sheet to increase the stiffness of the sheet. We have now discovered an improved method of treating the sheet material.

BRIEF SUMMARY OF THE INVENTION

According to the invention in one aspect there is provided a method of producing lightweight flexure-resistant thin metal sheet, the method comprising passing flexible sheet material of relatively thin gauge between two rolls each having teeth, each tooth having four flanks, each flank facing in a direction between an axial direction and a circumferential direction, the teeth having radiused corners, the rolls being arranged so that the teeth of one roll extend into gaps between teeth on the other, the rolls being rotated at substantially the same speed about generally parallel axes to form rows of projections on both faces of the sheet passed therethrough without damage to the surface material of the sheet.

We have realised that when flexible sheet material of relatively thin gauge is passed in the nip between rollers having teeth, the sheet surface can be damaged so that fragments of the sheet come away and accumulate in the spaces between teeth. The fragments then cause further damage to the sheet material which is following behind. most preferably the teeth are radiused in two areas: at the corners of the peak and at the peak. In other words it has been found according to the invention that by radiusing the comers of the teeth, preferably both at the peak and the root thereof, it is possible to cause the sheet material to flow in the clearance between opposed teeth to become more rigid with little or no thinning and without spalling of the sheet material or of the teeth. As a result the rolls suffer less wear and need less cleaning and last longer; the sheet material is rigid and yet lightweight. So far as we are aware it has not previously been the practice to radius the corners of teeth on rolls, and the benefits of doing so were unrealised.

The corners of the teeth are preferably radiused in the range from about 0.05 to 15 mm, most preferably 0.1 5 to about 4 mm. The extent of radius is related to the size of the tooth which in turn relates to the gauge of the sheet being processed. Where the tooth is relatively small for use with thin gauge sheet, the corner radios is Roput 0.2 and the peak is preferably about 1 mil; where the tooth is relatively large for thicker gauge sheet the corner radius is about 1 mil and the peak about 2.5. The ratio of the corner radius to the peak radius thus decreases with increasing size of the tooth. It has been observed that outside these parameters the tooth tends to have corners which can cut into the surface of the sheet material being treated. By virtue of the radiusing of the comers and the peaks of the teeth there is no risk that a sheet will occur. Such cracking releases fragments of the sheet material which tend to foul the space between the teeth of the roll which risk breaking the integrity of the surface of the sheet following on behind. We have surprisingly discovered that in the method of the invention not only does the sheet surface maintain its integrity but the formed sheet undergoes an enhanced stiffening effect as a result of which the mechanical strength, e.g. rigidity of the sheet is enhanced. The method of the invention may even be applied to a thin flexible sheet carrying a coating, e.g. a paint or like film without risk that it will be harmed.

In another aspect the invention provides a set of rolls, rows of teeth being present on the outer surface of the rolls, each tooth having four flanks of involute form, and each flank facing in a direction between an axial direction and a circumferential direction, the corners of the teeth being radiused as defined.

In another aspect the invention provides sheet material having projections on both of its surfaces, a corresponding depression being on the surface opposite each projection, the relative positions of the projections and depressions being such that lines drawn on the surface are non-linear, the sides of the projections lying a line extending between a longitudinal direction and a lateral direction, the overall distance between adjacent projections and depressions being within the range of 2 umm to 5 mm and in the range of four to ten times the gauge, wherein the corners of the projections and depressions are radiused.

In order that the invention may be well understood it will now be described with reference to the accompanying drawings in which:

DETAILED DESCRIPTION OF THE INVENTION

Figure 1:
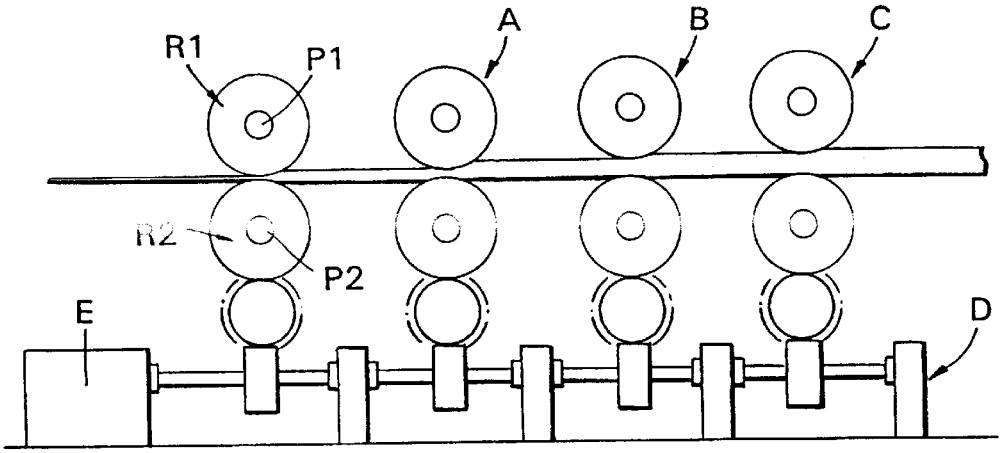
FIGS. 1 is a diagrammatic representation of the overall method.
Figure 4:
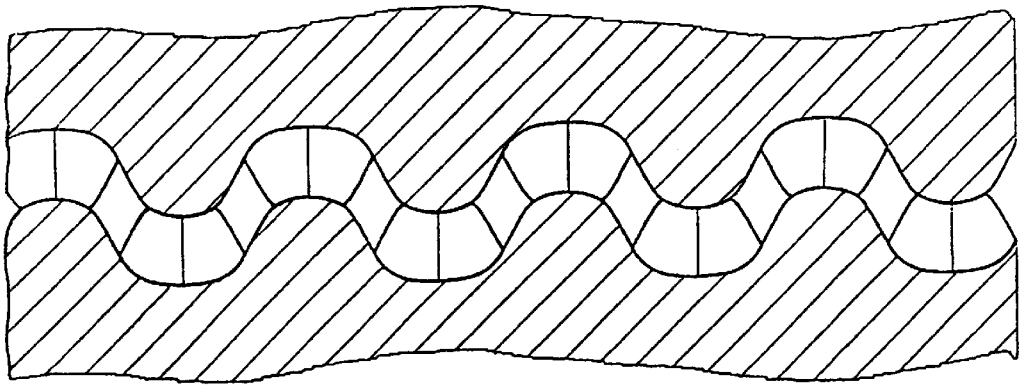
FIG. 4 is a sectional view taken on lines IV—IV on FIG. 2.
Figure 2:
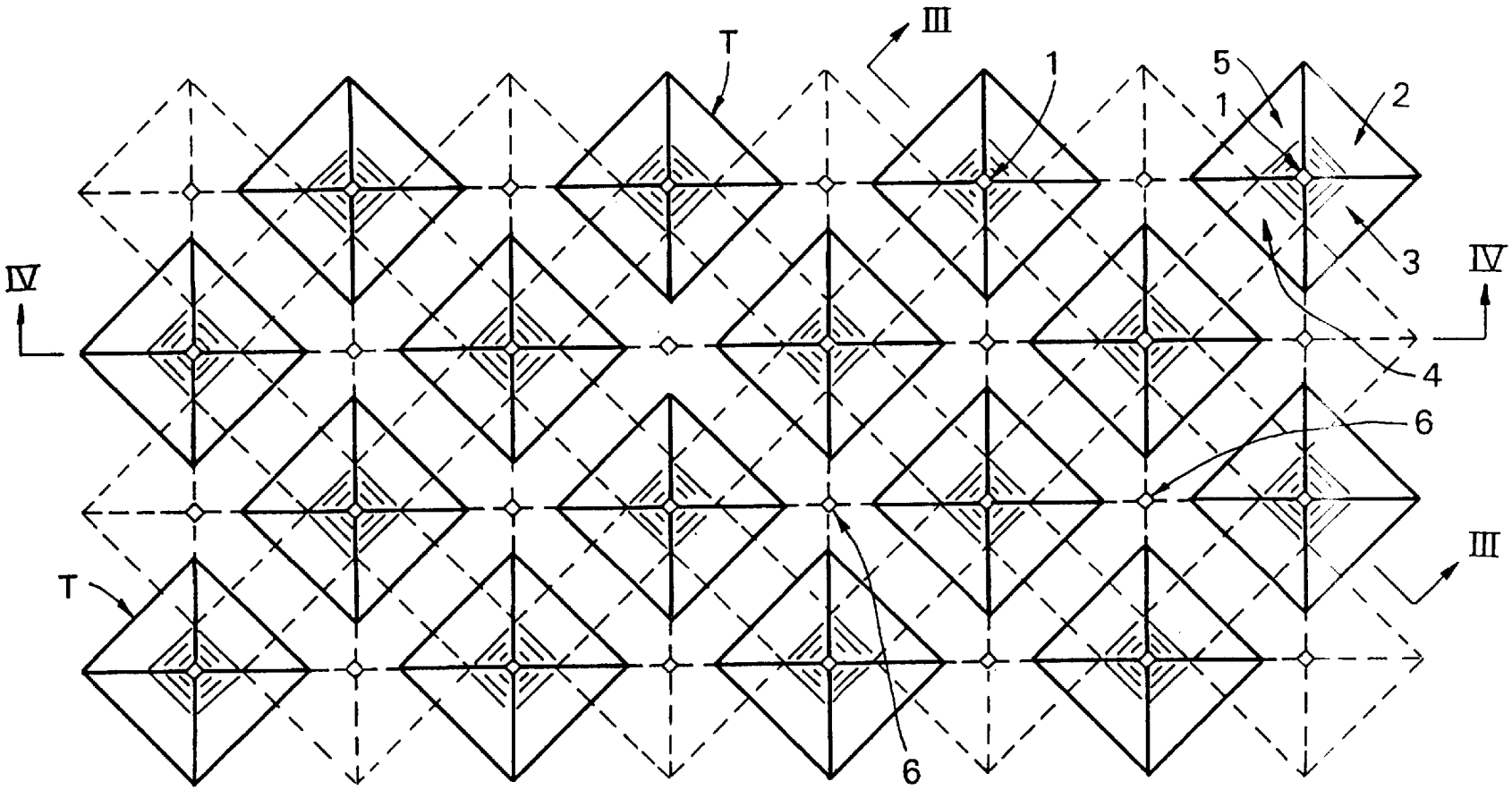
FIG. 2 is a fragmentary representation of part of the circumferential surface of the first set of rolls (shown at the left hand end of FIG. 1) with the positions of the teeth of an adjacent roll indicated by broken lines.
Figure 3:
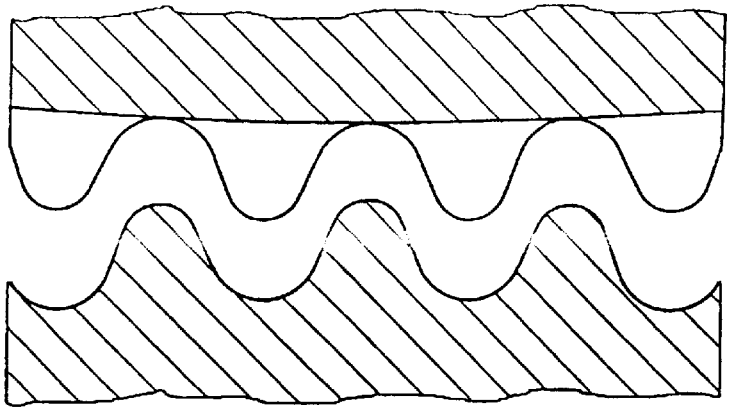
FIG. 3 is a sectional view taken on lines III—III on FIG. 2.

In the process shown in FIG. 1 thin sheet material S, typically metal, having a thickness of the order 0.05 mm to 2.5 mm is drawn from a coil and passed between a pair of identical rolls R1 ,R2 each of which has at its periphery a number of teeth T shown in FIG. 2. The rolls are rotated about their respective parallel axis P1,P2 and the sheet material is engaged and formed by the teeth T of the rolls. Each tooth pushes a part of the sheet material into a gap between teeth T on the other roll to form a projection facing that other roll and a corresponding depression facing the one roll. Thus, the overall thickness of the sheet material is increased by forming projections on both of its faces.

From the roll pair R1 and R2, the sheet material passes between the rolls of further pairs A,B,C which form the sheet material into a profile. The roll pair R1,R2 and the roll pairs A,B,C are driven for example by common drive means D of known form and including for example an electric motor E. The rolls are driven at substantially same speed between the rolls R1,R2 and then between the rolls of the subsequent pairs. After shaping, the sheet is cut into lengths for transportation and use.

Figure 7:
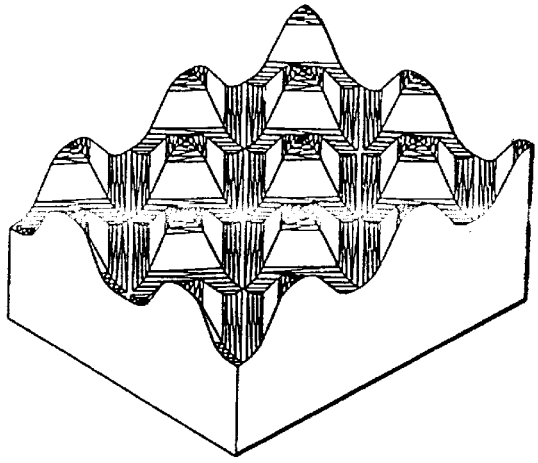
FIG. 7 is a perspective view of the form of the teeth on the roll of FIG. 2.

As shown in FIG. 2 each roll R1,R2 has on its periphery a number of identical teeth T arranged in a plurality of helical rows which are inclined to the axis of the roll at an angle of 45°. Each tooth has a peak 1 having a radius on each of the flanks 2,3,4,5 with each flank being inclined to the axis at an angle of 45°. From each edge of the peak, there extends a corresponding flank 2,3,4 and 5. Adjacent flanks meet at respective edges of the tooth. In the embodiment shown and as viewed in a direction from one of these edges to the other, the flank between the two edges has the form of an involute curve. All flanks of all of the teeth have the same form. It will be noted that the flanks of the teeth on the rolls face in directions which are between a circumferential direction and an axial direction. FIG. 7 is an enlarged perspective view of the teeth of the roll.

The sheet material S is gripped by and stretched by the teeth T when it passes between the rolls R1 and R2 so that the overall length of the sheet material is reduced only a little or not significantly. The reduction in the overall length (if any) depends upon a number of factors, including the thickness of the sheet material and the increase in the overall thickness which is caused by the rolls. We prefer that the length of the sheet material should not be reduced by more than 15% of the initial length. Generally, the length of the sheet material which leaves the rolls is at least 90% of the initial length and we prefer to maintain the length of the sheet material within the range 95% to 100% (or more) of the initial length. We prefer that the overall thickness of the sheet material leaving the rolls should be between two and three times the gauge of the sheet material. Subsequent treatment of the sheet material by the roll pairs A,B,C slightly reduces the overall thickness of the material.

As can be seen from FIG. 2, the flanks of the teeth of one roll R1,R2 face those of adjacent teeth across gaps 6 which gaps 6 are not occupied by teeth T of the other roll. At the nip between the rolls R1,R2, the teeth T enter gaps between edges of the teeth T with edges of each tooth T facing edges of adjacent teeth T.

In the gaps 6, the sheet metal S is free to adopt a form determined by forces applied to the sheet at the tips of the teeth T. These forces are such that the sheet does not remain flat in the gaps 6.

Figure 5:
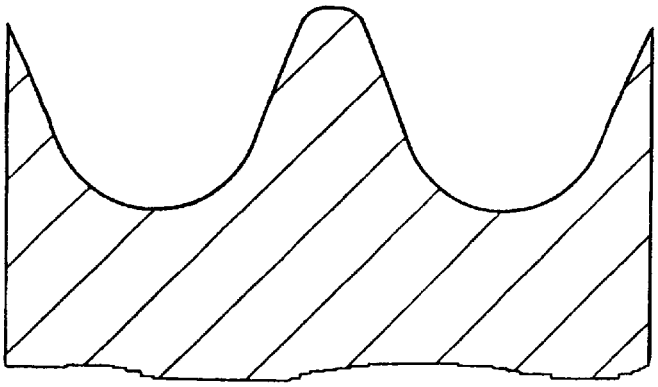
FIG. 5 is an enlarged sectional view showing the shape of a relatively small tooth form.
Figure 6:
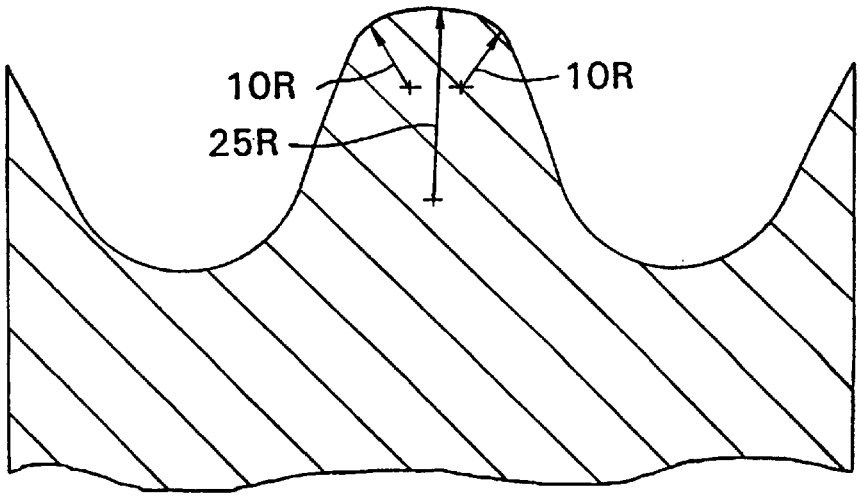
FIG. 6 is the same as FIG. 5 for a relatively large tooth form.

FIG. 5 and 6 show in enlarged scale the preferred small tooth form and a large tooth form for use with relatively thin and relatively thick gauge sheet material respectively. The broken vertical line is the axis of the tooth and the horizontal broken line is the pitch diameter. The extent of radiusing is selected to avoid corner shapes at any location which could damage the sheet material which it is being formed. We prefer to determine the extent of radiusing by a measurement technique used in relation to gears. FIG. 6 shows, in the case of the large tooth form, the centres of the radii which are preferably 1.0 mm for the corner radius and 2.5 mm for the peak. The corresponding values for the small tooth are 0.2 mm and 1.0 mm in both cases. As a result of these radiuses when the projections and depressions are formed in the sheet by passage through the rollers R1,R2 there is no cause for the sheet material to crack and release fragments which can lie in the space between the teeth of the rolls. Such fragments tend to accumulate and mar the projections and depressions formed on the subsequent sheet of the coil S and are avoided in this invention.

Figure 8:
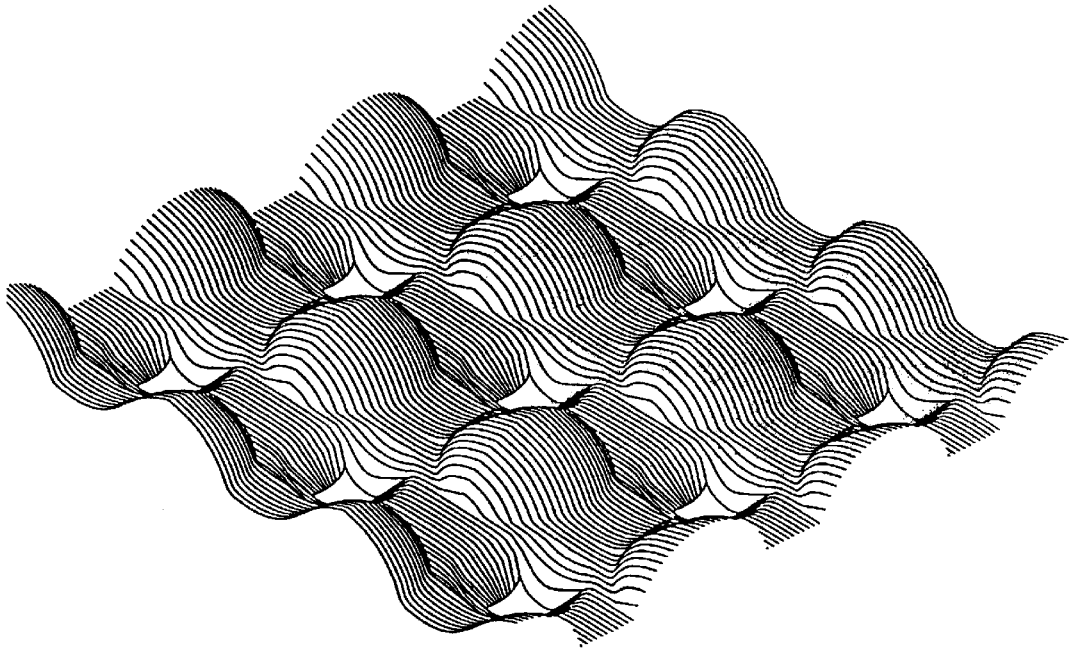
FIG. 8 is a perspective view of the projections formed on the sheet.

FIG. 8 shows the projections formed on sheet material of the invention. It will be noted that the projections and depressions are relatively smooth as a result of the radiused teeth of the rolls.

What is claimed is:

1. A method of making thin, flexible sheet metal rigid, the method comprising passing flexible sheet metal of relatively thin gauge between two rolls each having teeth, each tooth having four flanks and a top, the top having a peak and corners at the peak, each flank facing between an axial direction and a circumferential direction, the rolls being arranged so that the teeth of one roll extend into gaps between the teeth on the other, the top of the teeth being radiused at the peak and at the corners at the peak, the radius at the peak being from about 1.0 to about 2.5 mm and the radius at the corners at the peak being from about 0.2 to about 1.0 mm, the rolls being rotated at substantially the same speed about generally parallel axes to form rows of projections on both faces of the sheet metal passed therethrough, whereby the sheet is made rigid without damage to the street metal.

2. A method according to claim 1, wherein each tooth has a bottom having corners that are radiused.

3. A method according to claim 1, wherein the flexible sheet metal of relatively thin gauge used is of a thickness from 0.05 to 2.5 mm.

4. A set of rolls for use in cold rolling of plain sheet material, each roll having an outer surface, rows of teeth being present on the outer surface of the rolls, each tooth having four flanks of involute form and a top, each flank facing in a direction between an axial direction and a circumferential direction, wherein the top of the teeth each have a corner radius of from about 0.2 to about 1.0 mm, and a radius at a peak of the tooth of from about 1.0 to about 2.5 mm, the rolls being spaced apart in use by a distance such that the teeth on one roll extend into gaps between the teeth on the other roll, whereby projections are formed on both surfaces of the sheet material during its passage between the rolls, the teeth being arranged in generally parallel helical rows.

5. A set of rolls according to claim 4, wherein each tooth has a bottom having corners that are radiused.

6. A sheet of sheet metal having projections on both of its surfaces, a corresponding depression being present on the surface opposite each projection, the sheet having been prepared by a method comprising the steps of passing a flat sheet of flexible sheet metal of relatively thin gauge between two rolls each having teeth, each tooth having four flanks and a top, the top having a peak and corners at the peak, each flank facing between an axial direction and a circumferential direction, the rolls being arranged so that the teeth of one roll extend into gaps between the teeth on the other, the top of the teeth being radiused at the peak and at the corners at the peak, the radius at the peak being from about 1.0 to about 2.5 mm and the radius at the corners at the peak being from about 0.2 to about 1.0 mm, the rolls being rotated at substantially the same speed about generally parallel axes to form rows of projections on both surfaces of the sheet metal passed therethrough, whereby the sheet is rigid without damage to the surfaces of the sheet metal.

7. A method of making thin, flexible sheet metal rigid, the method comprising passing flexible sheet metal of relatively thin gauge between two rolls each having teeth, each tooth having four flanks and a top, the top having a peak and corners at the peak, each flank facing between an axial direction and a circumferential direction, wherein the teeth each have a radius selected to maximize the local stretching of the plain sheet material and to minimize the thinning of the material and to reduce damage to the surface of the material.

8. A method according to claim 7, wherein each tooth has a bottom having corners that are radiused.

9. A method according to claim 7, wherein the flexible sheet metal of relatively thin gauge is of a thickness from 0.05 to 2.5 mm.

10. A set of rolls for use in cold rolling of plain sheet material, each roll comprising an outer surface, the rolls having rows of teeth on the outer surface, each tooth having four flanks of involute form and a top, each flank facing in a direction between an axial direction and a circumferential direction, wherein the teeth each have a radius selected to maximize the local stretching of the plain sheet material and to minimize the thinning of the material and to reduce damage to a surface of the material.

11. A set of rolls according to claim 10, wherein each tooth has a bottom having corners that are radiused.

* * * * *